US006446269B1

(12) United States Patent
Bessler et al.

(10) Patent No.: US 6,446,269 B1
(45) Date of Patent: Sep. 10, 2002

(54) CONCEALED LOWER BODY GARMENT SUPPORT BELT

(76) Inventors: Ed Bessler, 8 Rosemont Dr., Crestview Hills, KY (US) 41017; Robert Roseberry, 5716 Hazel Dr., Boone County, KY (US) 41042

( * ) Notice: Subject to any disclaimer, the term of this patent is extended or adjusted under 35 U.S.C. 154(b) by 0 days.

(21) Appl. No.: 09/425,822

(22) Filed: Oct. 22, 1999

(51) Int. Cl.[7] ..... A41F 9/00
(52) U.S. Cl. ..... 2/321; 2/336; 2/338
(58) Field of Search ..... 2/321, 311, 312, 2/338, 920, 308; D2/634, 627

(56) References Cited

U.S. PATENT DOCUMENTS

| | | | | | |
|---|---|---|---|---|---|
| 683,720 | A | * | 10/1901 | Arnold | 2/311 |
| 745,245 | A | * | 11/1903 | Seligman | 2/311 |
| 946,656 | A | * | 1/1910 | Cole | 2/338 |
| 1,327,035 | A | * | 1/1920 | Greenwald | 2/338 |
| 1,597,508 | A | * | 8/1926 | Brenner | 2/338 |
| 2,392,761 | A | * | 1/1946 | Pease, Jr. | 2/311 |
| 3,571,814 | A | | 3/1971 | Miller | |
| 3,663,963 | A | | 5/1972 | Miller | |
| 3,778,845 | A | | 12/1973 | Miller | |
| 3,869,728 | A | | 3/1975 | Spencer | |
| 4,516,275 | A | | 5/1985 | Schroeder | |
| 4,583,249 | A | | 4/1986 | Kamat et al. | |
| 4,970,728 | A | | 11/1990 | D'Ambrosio | |
| 4,976,653 | A | | 12/1990 | White | |
| 4,999,853 | A | * | 3/1991 | Tanner | 2/321 |
| 5,309,572 | A | | 5/1994 | Seamans | |
| 5,483,702 | A | | 1/1996 | D'Ambrosio | |
| 5,515,544 | A | | 5/1996 | Hosking | |
| 5,517,697 | A | * | 5/1996 | Boehm | 2/338 |
| 5,638,550 | A | * | 6/1997 | Hube | 2/311 |
| 5,758,366 | A | * | 6/1998 | Wilson | 2/338 |

* cited by examiner

*Primary Examiner*—Gloria M. Hale
*Assistant Examiner*—Alissa L. Hoey
(74) *Attorney, Agent, or Firm*—R. Christian Macke

(57) ABSTRACT

A concealed lower body garment support belt worn under a lower body garment includes a raised lip on which the lower body garment is supported. The lip is formed from a loop in a length of fabric and is filled by filler material that is adequately flexible to conform to the shape of the user's waistline and rigid to resist flattening. The belt is worn by the user immediately adjacent to his skin or undergarments. A high friction surface and adjustable fastening means allow a snug fit to be obtained around the waistline to prevent slippage of the belt down the user's stomach. The belt is worn and maintained around the user's waistline so that the waistband of his lower body garment, supported on the raised lip of the belt, is maintained around the user's waistline. An exterior belt worn by a user cooperates with the concealed belt by cinching and gathering the waistband of the lower body garment over the raised lip of the concealed belt.

6 Claims, 4 Drawing Sheets

CONCEALED LOWER BODY GARMENT SUPPORT BELT

FIELD OF THE INVENTION

This invention relates to a device for maintaining a lower body garment at the wearer's waistline.

BACKGROUND OF THE INVENTION

Men and women have long fought the battle of the bulge around their mid-section and all of the problems that come with it. Often the first part of the body that experiences weight gain is around the mid section and stomach. The resulting paunch or enlarged stomach creates a number of problems, including increased difficulty wearing appropriately sized lower body garments, such as pants, shorts and skirts. This problem is most pronounced for men who do not gain weight in their legs proportionate to weight gain in stomachs and pregnant women who experience most of the weight grain associated with pregnancy in this region of the body.

A person having a larger stomach often experiences problems in wearing lower body garments, particularly pants, because the waistband of those lower body garments, which is designed and meant to encircle the wearer's torso just at the waistline above the pelvis, often slides down under the wearer's large stomach. The result is that the wearer must continually adjust his or her pants every time he stands up to bring the pants' waistband back up to the wearer's waistline, where it is intended to be.

There have been many attempts at solving the problem of the waistband sagging, including provision of attachment means such as adhesives or other interconnection devices attaching a lower body garment to an upper body garment. Coordinated buttons on pants and buttonholes in a related shirt accommodating the buttons are one example of such interconnection devices, well known in the prior art. In addition, interconnection of the pants to a garment worn over the shoulders, such as a jacket, is known in the art as a means for holding the pants up around the wearer's waistline. Emulating suspenders by connecting the pants to a garment worn over the shoulders, from which the lower body garment is then suspended, is well known in the art as a means for holding the pants up around the waistline. With all of the solutions to this problem there is one fundamental disadvantage.

Each interconnection of the lower body garment to an upper body or other garment creates another step and additional difficulty and inconvenience to attach and detach the lower body garment in the act of dressing and undressing. Thus, while those solutions are advantageous in that the lower body garment waistband stays in the desired location, they are also disadvantageous because they complicate dressing and undressing. Essentially, it becomes similar to wearing a one-piece jumpsuit. In the solution wherein the pants are interconnected to suspension hooks depending from a jacket worn by the user, the jacket must be connected and disconnected to the pants every time the user puts it on or takes it off.

Another specific example in solving the problem has been of adhesives between the lower body garment and an upper body garment. The problem with that solution is that the adhesive quickly wears out and must frequently be replaced.

There is thus identified a need for a device to keep the waistbands of lower body garments, such as pants, shorts and skirts, up around the wearer's waistline without requiring any interconnection with upper body garments or suspension from a garment worn over the shoulders.

OBJECTS OF THE INVENTION

It is an object of the present invention to provide a device worn by a user to support a lower body garment around the user's waistline.

It is another object of the present invention to provide a concealed device to support a lower body garment on the user's waistline.

It is a further object of the present invention to provide a device to keep a lower body garment up around the wearer's waistline that does not require attachment to an upper body garment or suspender-type device.

It is a further object of the present invention to provide a device to keep a lower body garment around a user's waistline which maintains its position on the user's body through frictional resistance with the user's body.

It is another object of the present invention to provide a device for holding a lower body garment around the wearer's waistline which cooperates with an external belt to maintain its position on the waistline.

It is another object of the present invention to provide a device concealed by the waistband of a lower body garment wherein said device frictionally engages user's skin or undergarments while supporting the lower body garment around the wearer's waist.

It is a further object of the present invention to provide a device for maintaining a lower body garment around the wearer's waistline that does not complicate dressing or undressing by the wearer.

It is another object of the present invention to provide a device for keeping a lower body garment up around the user's waistline which has a quick release means for locking and unlocking onto the user's body.

It is another object of the present invention to provide a device for maintaining a lower body garment around the user's waistline which includes comprising an elastic fabric and means for adjusting the size to accommodate different sized users and to allow for gradual loss of resiliency of the fabric's elasticity.

It is a further object of the present invention to provide a device to maintain a lower body garment around the user's waistline, said device having a raised lip which cooperates with an external belt worn on the lower body garment to maintain lower body garment around the wearer's waist.

SUMMARY OF THE INVENTION

This invention comprises a concealed lower body garment support device comprising a belt which is worn around a user's waistline under the lower body garment it is supporting. The belt is a length of fabric with a first end and a second end and an upper edge and lower edge. The belt encircles a user's body at the waistline and includes a means for fastening the first end. In the most preferred embodiment, the means for fastening comprises a quick release means for locking and unlocking the belt onto the user's body. The means for fastening, comprising strips of hook and loop fasteners extending along a portion of the belt and overlap to join the first end to the second end, also provide a means for adjusting the belt to accommodate different sized users by varying the amount of the overlap. In addition, by varying the amount of the overlap, the belt can be adjusted to accommodate gradual loss of elasticity of the belt.

A raised lip is provided along the lower edge of the belt so that when a lower body garment is pulled up over the belt and fastened, it does not slide down the user's stomach, but rather is maintained around the user's waistline on the raised lip of the belt.

The raised lip of the belt is preferably constructed by folding over a portion of the belt along its length and affixing it to itself at a seam. A loop extending along the length of the belt at its lower edge is created thereby. The raised lip of the belt is then expanded by filling the loop with flexible material to increase the size of the lip and improve its support characteristics. The flexible filler material conforms to the user's waistline but is adequately stable that it cannot be flattened, so that the raised lip maintains its shape.

The concealed lower body garment support belt is preferably constructed from an elastic material that allows it to hug the user's body or undergarments snugly so that, as a result of the high friction interior surface, the belt does not slide down over the user's stomach. As the elasticity of the belt wears out, it is adjusted by changing the overlap of the hook and loop fastener strips so that the same snug fit around the user's waistline is maintained.

The invention disclosed herein is advantageous over the prior art because it provides a simple device for maintaining a lower body garments, such as pants, shorts or skirts, around a user's waistline without requiring any additional fastening to upper body garments or suspender attachments that go over the shoulders. The concealed lower body garment support belt of the present invention relieves the user of the need to repeatedly pull a lower body garment up over his stomach, without attaching the lower body garment to an upper body garment or suspender mechanism. The belt of the present invention maintains its position around the users waistline better than the pants, shorts or skirts do by themselves or with the attachment of an external belt as the result of its high friction inner surface and snug fit facilitated by the elastic material and adjustment of the hook and loop fastener overlap. It provides this advantage without requiring any complication to the dressing and undressing by the user.

DETAILED DESCRIPTION OF THE INVENTION

The present invention comprises a concealed lower body garment support belt 10 which wraps around a user's body at his waistline and supports a lower body garment, such as pants, shorts or a skirt worn by the user which would otherwise be prone to slide down over the user's stomach. The user is forced to repeatedly hike up the lower body garment to bring its waistband back up to the user's waistline.

Figure 4:
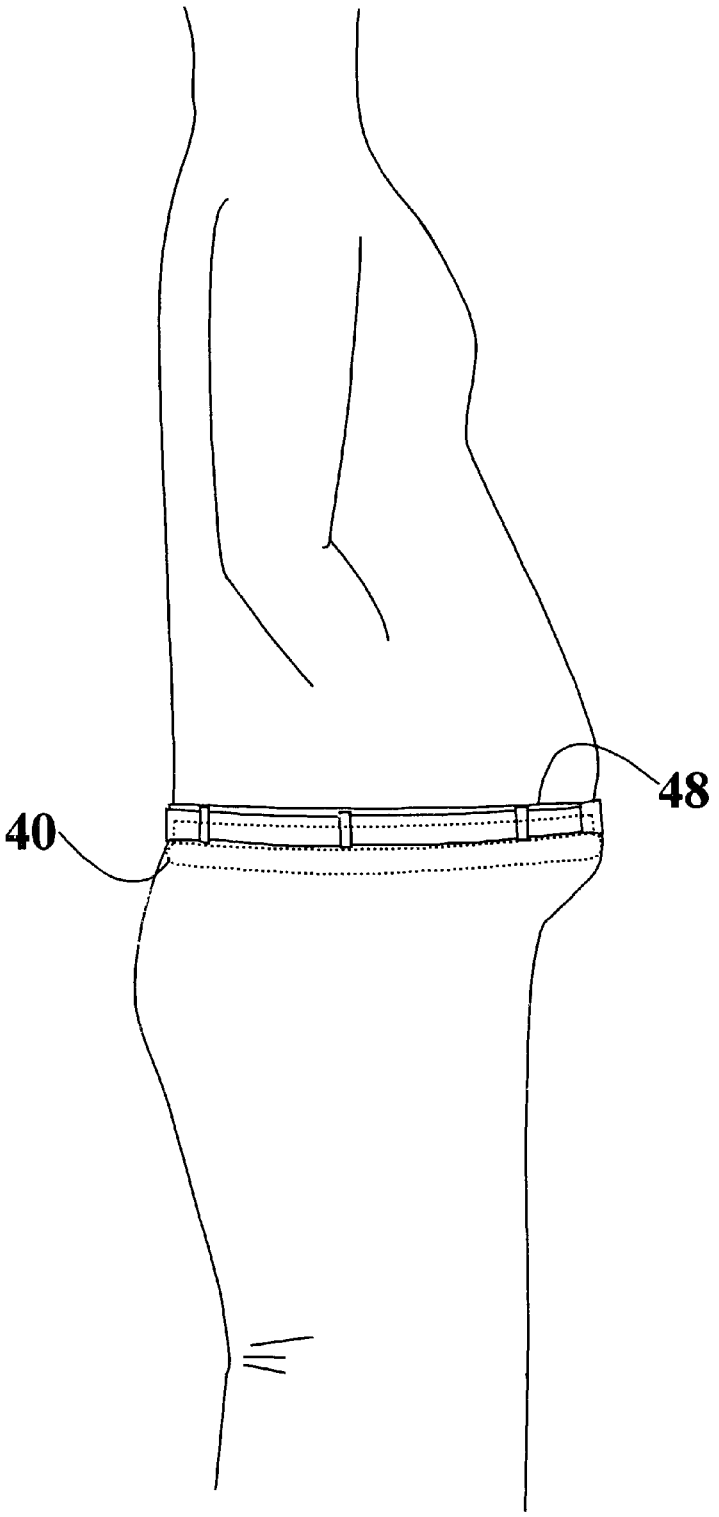
FIG. 4 is a side view of a user depicting the user of the concealed lower body garment support belt of the present invention.

The belt 10 comprises a length of fabric 12 having a first end 14 and a second end 16 which can be wrapped around a user's waist as depicted in FIG. 4. In the preferred embodiment of the present invention, the length of fabric 12 is formed from an elastic material having a high friction interior allowing a snug fit around the user's waist, although other materials are specifically contemplated hereby such that their use does not depart from the principles of the present invention.

Figure 1:
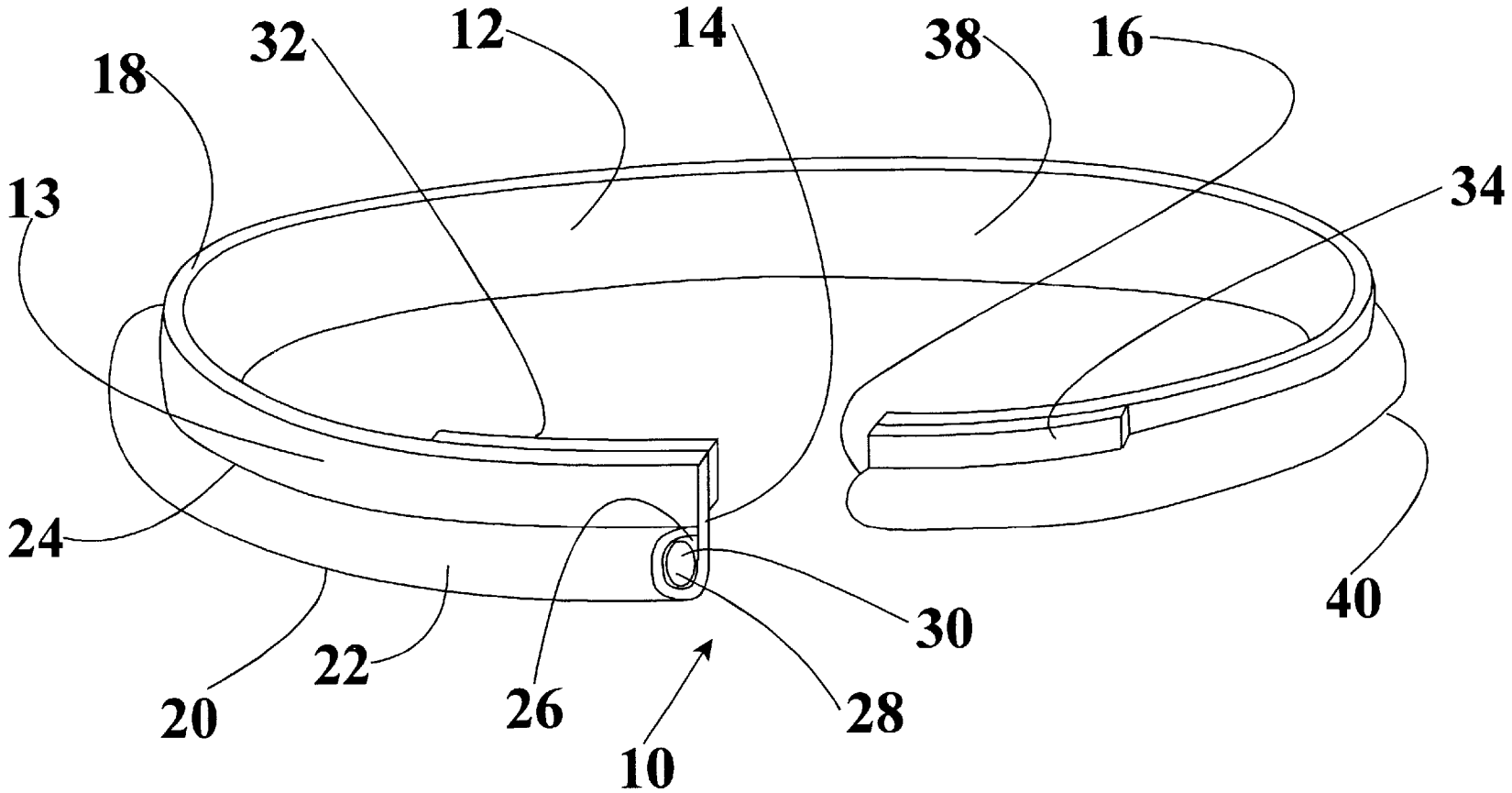
FIG. 1 is a perspective view of the concealed lower body garment support belt of the present invention.
Figure 2:
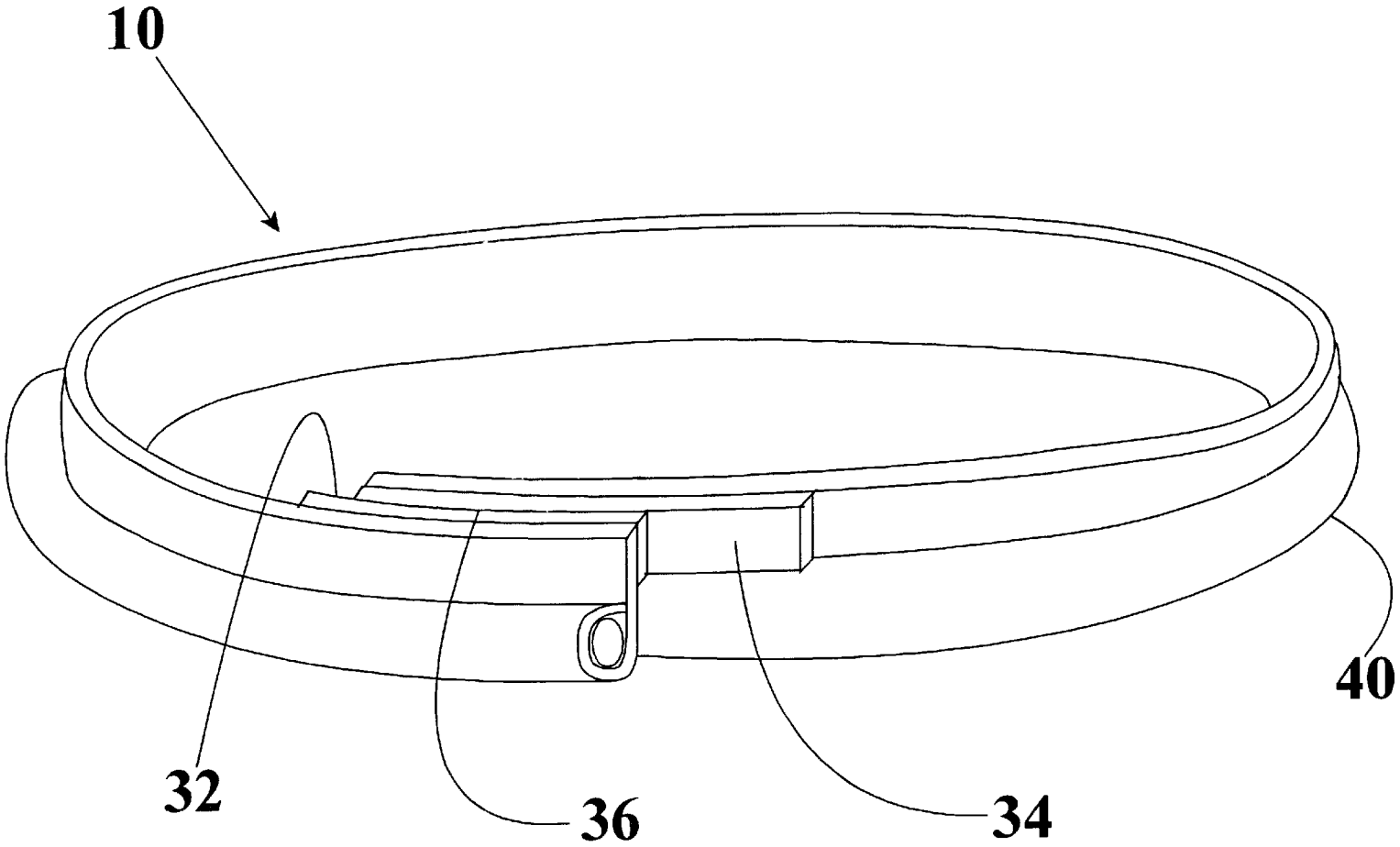
FIG. 2 is a perspective view of the concealed lower body garment support belt of the present invention reflecting the overlap between the first and second end.

The length of fabric 12 has an upper edge 18 and a lower edge 20, as shown in FIG. 1, and is formed such that a portion of the length of fabric 12 is doubled over and affixed to itself at a seam 24 leaving an upper portion 13 which is not doubled over and remains essentially flat. Doubling over of the bottom portion 22 and affixation at the seam 24 creates a loop 26 in the length of fabric 12 of increased thickness compared to the upper portion 13 of the belt 10 and provides an advantageous lip 40 that helps support the lower body garment 44 as discussed in more detail herein.

The loop 26 is filled with filler material 28 to further increase the thickness of the lip 40 and improve the support and maintenance characteristics of the lip 40. The filler material 28 is adequately flexible to conform to the user's waistline but is adequately sturdy and rigid that it cannot be flattened or squashed so that the benefit of the protruding lip 40 is maintained. In the preferred embodiment, the filler material 28 comprises a length of rigid rubber tubing 30 which readily slides into and out of the loop 26 and is adequately flexible to conform its shape to encircle the user's waist.

At the first end 14 of the belt 10, a hook strip 32 of a hooks and loops type connector is affixed, while a loop strip 34 is affixed to the second end 16 of the belt 10. The length of the hook strip 32 and loop strip 34 are adequate so that the belt 10 has a wide range of adjustment for different sized users. This is particularly advantageous because a user can alter the amount of overlap 36 between the hook strip 32 and loop strip 34 to vary the size of the belt 10 to accommodate different sized users or to make up for any loss in elasticity of the belt 10. To maintain a snug fit around the user's waistline, the overlap 36 is increased.

The belt 10 is worn by a user by attaching the first end 14 to the second end 16 to create the overlap 36.

In addition to providing a means for adjusting the size of the belt 10, the hook strip 32 and loop strip 34 also provide a quick release means for the belt 10. The present invention is advantageous over the prior art because there is no connection to any upper body garment or suspender device that complicates dressing and undressing. Moreover, the quick release means of the hook strip 32 and loop strip 34 further simplifies the use of the belt 10.

Figure 3:
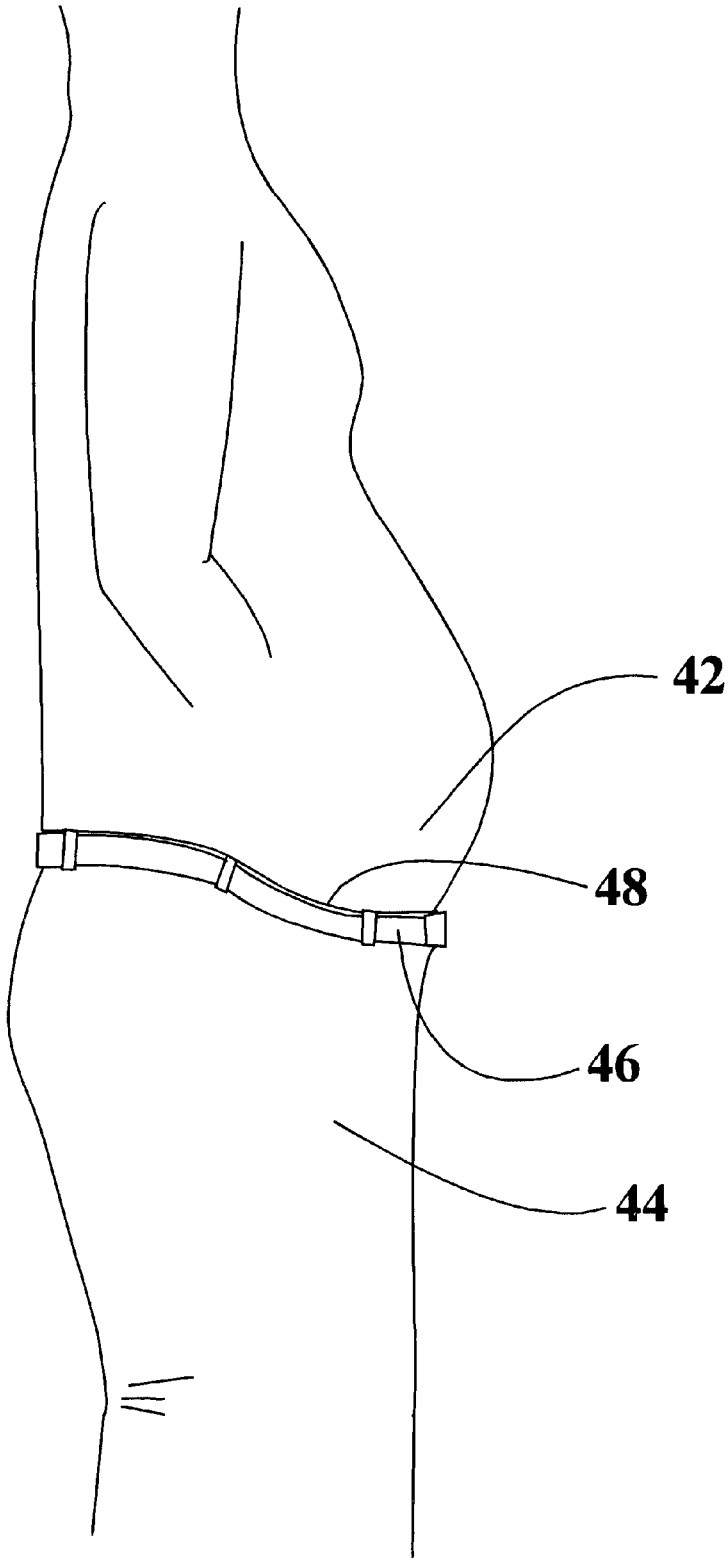
FIG. 3 is a side view of a user depicting the problem addressed by the present invention, the drooping of the waistband of a lower body garment under and enlarged stomach.

The problems solved by the present invention is illustrated in FIG. 3 wherein a user is depicted having pants 44 which have slid down over his stomach 42 such that the waistline 48 of the pants 44 is no longer around the user's waistline. The belt 10 supports a lower body garment 44 by providing a lip 40 around a user's waistline over which the garment 44 will not slide. As shown in FIG. 4, the additional use of an external belt 46 above the lip 40 acts as a cinch and, when tightened, gathers and secures the waistband 48 of the lower body garment 44 above it.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A concealed lower body garment support belt worn around a user's waistline under a lower body garment, said lower body garment supported by an external belt worn by the user outside the lower body garment, said lower body garment support belt comprising:

a length of fabric comprising elastic material having a first end, a second end, an upper edge and a lower edge;

means for fastening said first end to said second end;

a high friction interior surface maintaining the position of said concealed lower body garment support belt on a user's body through frictional resistance with said user's body;

quick release means for locking and unlocking said concealed lower body garment support belt onto a user's body;

a raised lip along said lower edge, said raised lip cooperating with said external belt such that said external belt acts as a cinch that tightens, gathers and secures a waistband of said lower body garment above said raised lip; and means for adapting the size of said concealed lower body garment support belt, said size adapting means allowing the concealed lower body garment support belt to be adjusted to maintain a snug fit around a user's waistline as the elasticity of said concealed lower body garment support belt wears out.

2. The concealed lower body garment support belt of claim 1 wherein said raised lip comprises a portion of said length of fabric doubled over and affixed to itself at a seam to create a loop of increased thickness along said lower edge.

3. The concealed lower body garment support belt of claim 2 wherein said loop is filled with a filler material that is adequately flexible to conform to the user's waistline and adequately sturdy that said filler material cannot by flattened or squashed.

4. The concealed lower body garment support belt of claim 3 wherein said filler material comprises a length of rigid rubber tubing that readily slides into and out of said loop of increased thickness along said lower edge.

5. The concealed lower body garment support belt of claim 4 wherein said quick release means comprises a hooks and loops type connector comprising a hook strip affixed to said first end and a loop strip affixed to said second end.

6. The concealed lower body garment support belt of claim 5 wherein said means for adapting the size of said belt comprises an adequate length of said hook strip and an adequate length of said loop strip to alter an amount of an overlap between said hook strip and said loop strip as necessary to maintain a snug fit around a user's waistline as the elasticity of the lower body garment support belt wears out.

* * * * *